US005376021A

United States Patent [19]

Rodrigues et al.

[11] Patent Number: 5,376,021

[45] Date of Patent: Dec. 27, 1994

[54] ENHANCED PERFORMANCE DATA CONNECTOR

[75] Inventors: Julio F. Rodrigues, Collierville, Tenn.; Richard Podgalsky, Cranford, N.J.; Richard Marowsky, Collierville, Tenn.

[73] Assignee: Thomas & Betts Corporation, Memphis, Tenn.

[21] Appl. No.: 13,857

[22] Filed: Feb. 5, 1993

[51] Int. Cl.[5] ..... H01R 13/648

[52] U.S. Cl. ..... 439/608; 439/607

[58] Field of Search ..... 439/607, 608, 609, 610, 439/188, 101, 108

[56] References Cited

U.S. PATENT DOCUMENTS

| | | | |
|---|---|---|---|
| Re. 32,760 | 10/1988 | Chandler et al. | 439/188 |
| 3,606,155 | 9/1971 | Windsor | 439/108 |
| 3,688,243 | 8/1972 | Yamada et al. | 439/293 |
| 4,449,778 | 5/1984 | Lane | 439/610 |
| 4,451,107 | 5/1984 | Dola et al. | 439/608 |
| 4,456,317 | 6/1984 | McCleerey | 439/101 |
| 4,470,657 | 9/1984 | Deacon | 439/609 |
| 4,501,459 | 2/1985 | Chandler et al. | 439/289 |
| 4,508,415 | 4/1985 | Bunnell | 439/497 |
| 4,552,423 | 11/1985 | Swengel, Jr. | 439/507 |
| 4,571,014 | 2/1986 | Robin et al. | 439/108 |
| 4,582,376 | 4/1986 | Olsson | 439/514 |
| 4,602,833 | 7/1986 | Grabbe et al. | 439/292 |
| 4,619,494 | 10/1986 | Noorily et al. | 439/449 |
| 4,641,906 | 2/1987 | Olsson | 439/465 |
| 4,653,825 | 3/1987 | Olsson | 439/289 |
| 4,659,163 | 4/1987 | Althouse et al. | 439/608 |
| 4,671,599 | 6/1987 | Olsson | 439/188 |
| 4,711,507 | 12/1987 | Noorily | 439/292 |
| 4,711,511 | 12/1987 | Noorily | 439/347 |
| 4,731,032 | 3/1988 | Noorily | 439/136 |
| 4,744,769 | 5/1988 | Grabbe et al. | 439/284 |
| 4,824,383 | 4/1989 | Lemke | 439/108 |
| 4,846,727 | 7/1989 | Glover et al. | 439/608 |
| 4,859,201 | 8/1989 | Marsh | 439/290 |
| 4,869,676 | 9/1989 | Demler, Jr. et al. | 439/79 |
| 4,883,433 | 11/1989 | Lane | 439/607 |
| 4,884,981 | 12/1989 | Chandler et al. | 439/610 |
| 4,891,022 | 1/1990 | Chandler et al. | 439/610 |
| 4,898,546 | 2/1990 | Elco et al. | 439/608 |
| 5,030,114 | 7/1991 | Carey et al. | 439/92 |
| 5,035,647 | 7/1991 | Schafer | 439/557 |
| 5,052,940 | 10/1991 | Bengal | 439/188 |
| 5,074,803 | 12/1991 | Chandler | 439/347 |
| 5,088,934 | 2/1992 | Chow et al. | 439/395 |
| 5,104,337 | 4/1992 | Chow et al. | 439/470 |
| 5,104,341 | 4/1992 | Gilissen et al. | 439/608 |
| 5,112,243 | 5/1992 | Chow et al. | 439/352 |
| 5,122,076 | 6/1992 | Pitts | 439/352 |
| 5,160,273 | 11/1992 | Carney | 439/608 |
| 5,169,346 | 12/1992 | Johnston | 439/676 |
| 5,190,464 | 5/1993 | Chow et al. | 439/188 |
| 5,228,871 | 7/1993 | Goodman | 439/607 |

OTHER PUBLICATIONS

IBM Technical Disclosure Bulletin (vol. 16, No. 5, Oct. 1973) Hermaphroditic Connector–pp. 1505–1506.

*Primary Examiner*—Larry I. Schwartz
*Assistant Examiner*—Hien D. Vu
*Attorney, Agent, or Firm*—Robert M. Rodrick

[57] ABSTRACT

A shielded electrical data connector terminates a shielded multiconductor cable. The data connector includes an insulative housing having a conductive housing shield therein. A contact holding member is accommodated in the connector housing and supports a row of plural spaced electrical contacts thereon. A contact shield is supported by the contact holding member. The contact shield has a shield extension extending between at least two of the contacts so as to reduce cross-talk as between the two contacts. The contact shield is electrically commoned with the housing shield to maintain continuous electrical shielding.

17 Claims, 2 Drawing Sheets

ENHANCED PERFORMANCE DATA CONNECTOR

FIELD OF THE INVENTION

The present invention relates generally to improvements in shielded electrical data connectors. More particularly, the present invention relates to a shielded electrical data connector having enhanced performance.

BACKGROUND OF THE INVENTION

The use of electrical connectors to terminate electrical cable carrying data transmission signals is well-known. Electrical connectors of this type are shown in numerous patents including U.S. Pat. No. 4,449,778, U.S. Pat. No. 4,501,459 and U.S. Pat. No. 4,619,494. Each of the connectors described in these patents includes a connector shield. Shielded connectors provide protection from electromagnetic and radio frequency interferences (EMI and RFI) which may be present in the environment.

Recently, the industry has been increasing the rate of data signal transmission along the data cable. Data rates of 100 mbps are now being achieved. These increased data rates result in an increase in the cross-talk levels between the conductors of the cable, which are terminated in the electrical connector. While the shielding provided in the above-identified data connectors is adequate for the lower transmission rates, it has been found that this shielding may not be sufficient for the increased signal rates. At high data rates, the cross-talk problem particularly prevalent as between adjacent pairs of contacts supported in the data connector housing. Improvements in data connector shielding have been attempted. U.S. Pat. No. 5,030,114 shows an improved data connector shield overcoat. However, improvements such as this do not address cross-talk.

It is, therefore, desirable to provide an electrical connector which provides improved shielding to reduce the cross-talk between contact pairs at high data rates.

SUMMARY OF THE INVENTION

It is an object of the present invention to provide an improved electrical data connector.

It is a further object of the present invention to provide improved shielding in an electrical data connector.

It is a still further object of the present invention to provide improved shielding in a data connector so as to reduce cross talk between contacts of the connector.

In the efficient attainment of these and other objects, the present invention provides a data connector assembly including an insulative housing having a metallic housing shield therearound. A contact holding member supports a row of plural spaced electrical contacts thereon. The insulative housing accommodates the holding member therein. A contact shield is supported by the contact holding member. The contact shield has shield extensions which extend between at least two of the contacts supported on the holding member and on each side of the contact row. The contact shield is electrically commoned with the housing shield.

As more particularly described by way of the preferred embodiment herein, the contact holding member includes a pair of sidewalls bounding the row of contact and a central dividing wall extending between at least two of the contacts. The contact shield extensions extend within slots in the sidewalls of the contact holding member as well as the dividing wall.

DETAILED DESCRIPTION OF THE PREFERRED EMBODIMENTS

Figure 1:
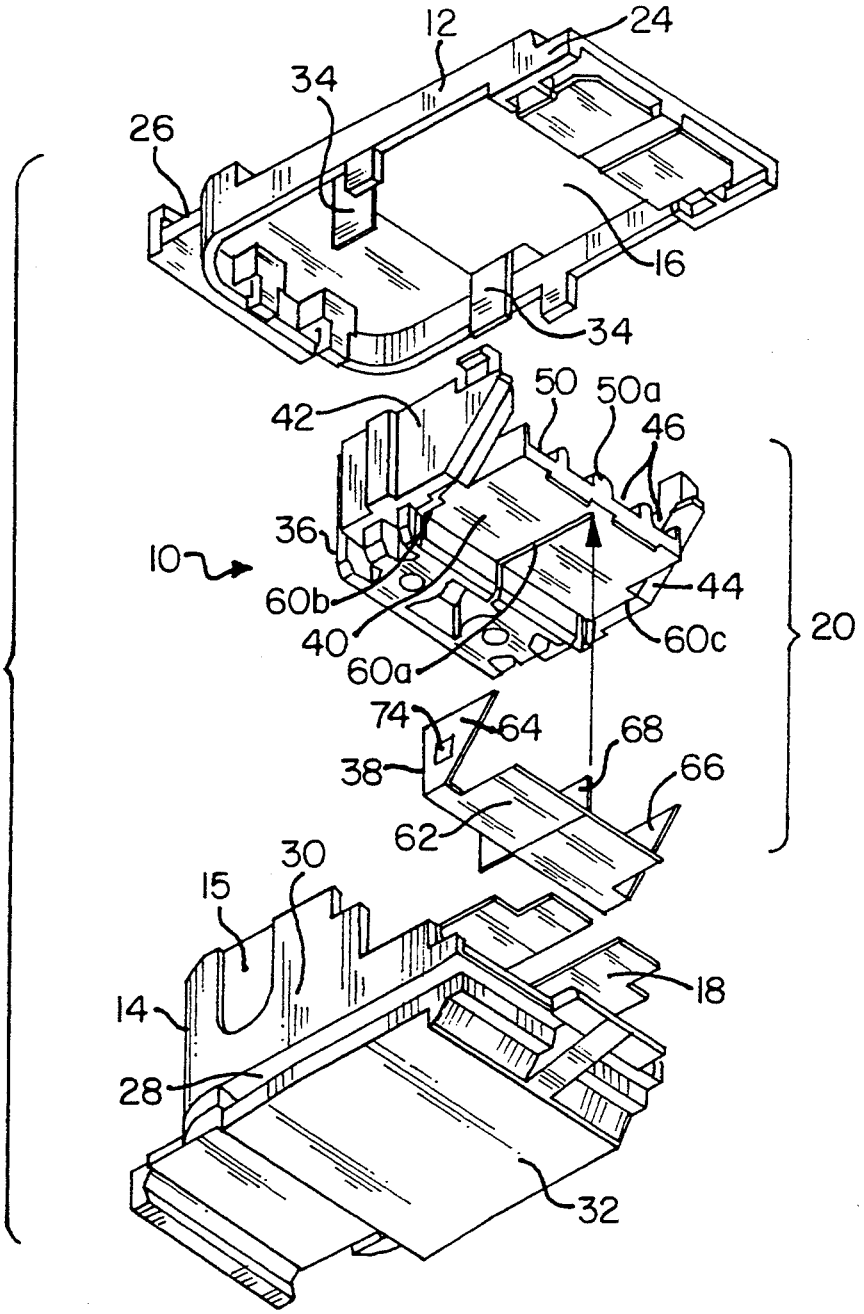
FIG. 1 shows an exploded perspective view of components of the electrical data connector assembly of the present invention.

Referring to FIG. 1, a shielded electrical data connector assembly 10 of the present invention is shown. Data connector 10 is of the type used to terminate a multiconductor shielded data cable (not shown) and is substantially similar to the connector shown in U.S. Pat. No. 4,619,494, issued Oct. 28, 1986, entitled "Shielded Electrical Connector," which is assigned the assignee of the present invention and which is incorporated by reference herein for all purposes.

Connector 10 comprises an insulative housing defined by a cover 12 and a base 14. Connector 10 also includes an upper electrically conductive shield 16, a lower electrically conductive shield 18, and a conductor termination sub-assembly 20, also shown in FIG. 2. Cover 12 includes an elongate generally planar lid 24 supporting a latching mechanism 26. Base 14 includes a bottom wall 28 and an upstanding sidewall 30, which partially surrounds bottom wall 28. Sidewall 30 includes one or more cable entry ports 15 for accommodating the data cable. Base 14 also includes latching mechanism 32, which in combination with latching mechanism 26 of cover 12 permits interconnection of connector 10 with another similarly constructed connector in a manner described in greater detail in the above-identified '494 patent. Upper shield 16 is a planar metallic member which substantially encompasses the lower surface of cover 12. Lower shield 18 is also a planar member which covers the upper surface of bottom wall 28 of base 14. Depending shield members 34, extending from upper shield 16, engage lower shield 18 to provide electrical continuity therebetween. The manner in which upper shield 16 and lower shield 18 effectively shields connector 10 from EMI and RFI is also more fully described in the above-identified '494 patent.

Housed between cover 12 and base 14 is conductor subassembly 20. With additional reference to FIG. 2, conductor subassembly 20 includes an insulative contact holder 36 and a contact shield 38. Contact holder 36 comprises a bottom wall 40 and two transversely spaced upstanding sidewalls 42 and 44. A plurality of spaced parallel channels 46 are provided in bottom wall 40. A transverse wall 48 of height less than the sidewalls extends across the rear of bottom wall 40. Channels 46 are defined by longitudinal dividers 50 extending upwardly from bottom wall 40 with a central divider **50*a*** having a greater thickness than the other dividers.

Figure 2:
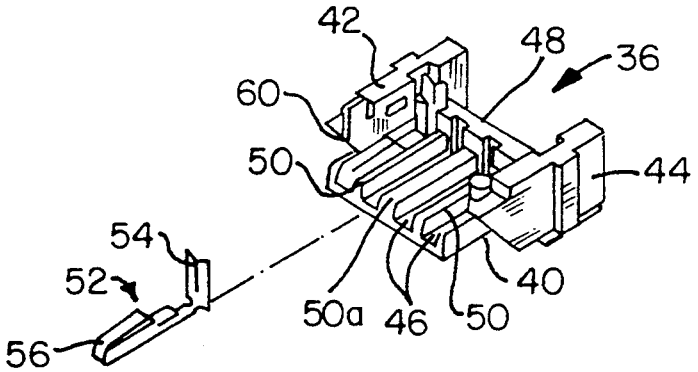
FIG. 2 shows the contact holder of the assembly of FIG. 1.

A plurality of electrical contacts 52 are supported by holder 36. Contact 52 is an elongate member formed of a suitably conductive material and includes at the other end a conductor connection portion 54, which, as shown in FIG. 2, is an insulation displacement contact portion for connection with the multiconductor cable.

Contact 52 also includes at the other end a connection portion 56 for electrical connection with another similarly formed electrical contact. Contacts 52 are fixedly secured in holder 36 in respective channels 46 with dividers 50 electrically isolating each of the individual contacts 52.

In the present embodiment, four contacts 52 are supported in holder 36. These contacts 52 considered in pairs, that is two contacts of one pair being on one side of divider 50*a* and two contacts of another pair being on the other side of divider 50*a*. In order to provide for reduced cross talk as between contacts 52, especially as between each pair of contacts supported on each side of divider 50*a*, the present invention contemplates interposing a contact shield 38 within contact holder 36. Contact holder 36 is modified from that shown in the above-identified '494 patent to have a plurality of slots 60 therein. A longitudinal central slot 60*a* extends from bottom wall 40 up through longitudinal central divider 50*a* along the length thereof. A pair of elongate lateral slots 60*b* and 60*c* extend from bottom wall 40 up through sidewalls 42 and 44 respectively.

Figure 3:
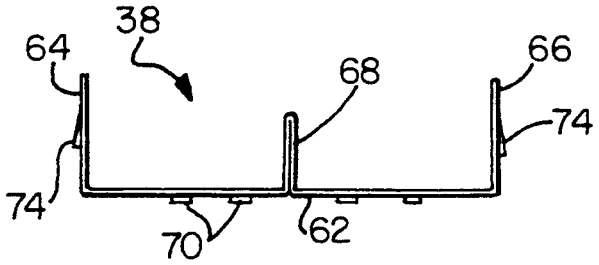
FIGS. 3, 4, and 5 show front, side and bottom views, respectively, of the improved contact shield of the assembly of FIG. 1.
Figure 4:
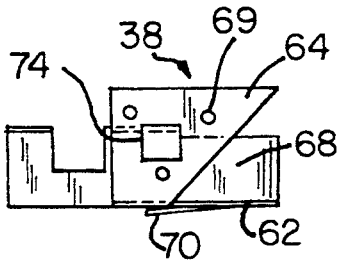
Figure 5:
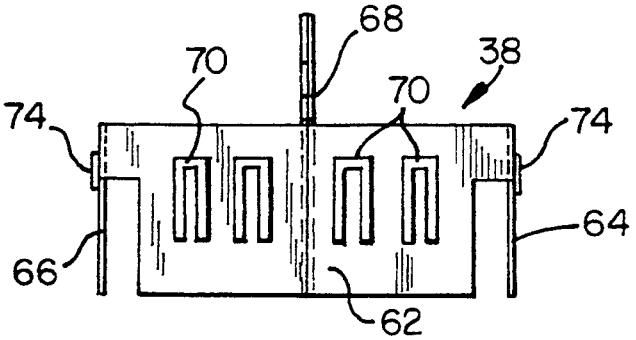

Referring additionally now to FIGS. 3 through 5, contact holder 36 is constructed to accommodate contact shield 38 therein. Shield 38 is a metallic member formed of stamped material, having a bottom planar surface 62, which is constructed to be in conformance with bottom wall 40 of holder 36 and a pair of upstanding transversely spaced side extensions 64 and 66. A planar central extension 68 extends upwardly from planar surface 62 between side extensions 64 and 66. Side extensions 64 and 66 are constructed to be received within lateral slots 60*b* and 60*c*, respectively, and central extension 68 is designed to be received within central slot 60*a* of contact holder 36. Each of side extensions 64 and 66 and central extension 68 are of sufficient height and length to span the length of elongate contacts 52 to provide cross-talk shielding for the contacts supported between dividers 50 of holder 36. Specifically, central extension 68 shields the pair of contacts 52 on one side of divider 50*a* from the pair of contacts 52 on the other side of divider 50*a*.

In order to insure that contact shield 38 is commoned with the shield of connector 10, contact shield 38 includes a plurality of electrical engagement fingers 70 thereon. Planar surface 62 of shield 38 includes four dual-beam contact fingers 70, which are in the form of cantilevered spring elements struck from the surface thereof. Dual beam contact fingers 70 extend downwardly to engage lower shield 18 of base 14 to establish electrical engagement therewith.

In addition, side extensions 64 and 66 include lances 74, which are struck outwardly from the surface thereof. Lances 74 engage sidewalls 42 and 44 within slots 60*b* and 60 to frictionally secure contact shield 38 on contact holder 36.

As can be appreciated, electrical continuity is maintained as among upper shield 16, lower shield 18, and contact shield 38. The electrically continuous shield established will not only shield the connector from external EMI and RFI, but will also provide cross-talk reduction as between pairs of contacts 52 supported within connector 10.

Various changes to the foregoing described and shown structures would now be evident to those skilled in the art. Accordingly, the particularly disclosed scope of the invention is set forth in the following claims.

We claim:

1. A data connector comprising:

an insulative housing having a conductive housing shield therein;

an insulative contact holding member supporting a row of plural spaced electrical contacts thereon, said insulative housing accommodating said holding member; and a contact shield supported by the contact holding member, said contact shield having a shield extension extending between at least two of said contacts, said contact shield including additional shield extensions, one additional shield extension bounding each side of said row of contacts, said contact shield being electrically commoned with said housing shield, said contact holding member further including a pair of sidewalls bounding said row of contacts and a central dividing wall extending between at least two contacts, said sidewalls and said central dividing wall of said holding member including slots therein, said shield extensions being accommodated in said respective slots in said sidewalls and said dividing wall.

2. A data connector of claim 1 wherein said contact shield includes spring fingers for electrical engagement with said conductive shield of said housing.

3. A data connector comprising:

an insulative housing supporting a conductive housing shield having a planar portion;

an insulative contact holding member supported within said housing, said contact holding member supporting a plurality of spaced, elongate electrical contacts of predetermined length thereon in side-by-side arrangement generally in a plane substantially parallel to said shield planar portion;

a contact shield supported by said contact holding member, said contact shield having a planar extent overlying said contacts and being generally parallel to the plane of said contacts, said contact shield having a shield extension extending generally transversely to said contact shield planar extent and between at least two of said contacts, said shield extension having a length spanning the length of said at least two contacts, said contact shield being electrically commoned with said housing shield.

4. A data connector of claim 3, wherein said contact shield includes a pair of side extensions, one side extension bounding each side of said plurality of spaced, elongate electrical contacts.

5. A data connector of claim 4, wherein said shield extension and said pair of side extensions all extend substantially perpendicularly to said shield planar extent.

6. A data connector of claim 4, wherein said contact holding member supports four electrical contacts arranged in two pairs, each pair of contacts being bounded by one of said shield side extensions and said shield extension.

7. A data connector of claim 6, wherein said contact shield includes means in electrical engagement with said conductive shield of said housing.

8. A data connector of claim 6, wherein said contact holding member includes a pair of sidewalls bounding each side of said row of contacts and a central dividing wall extending between each pair of contacts.

9. A data connector of claim 8, wherein said sidewalls and said central dividing wall of said contact holding member each have slots therein respectively receiving therein said shield side extensions and said shield extension.

10. A data connector of claim 3, wherein said housing shield planar portion overlies a portion of said contact shield planar extent and is substantially parallel thereto.

11. A data connector comprising:

an insulative housing supporting a conductive housing shield therewithin;

an insulative contact holding member supporting a row of plural spaced electrical contacts thereon, said insulative housing accommodating said holding member therewithin with said housing shield being situated between said contacts and said insulative housing; and a contact shield supported by said contact holding member, said contact shield having a shield extension extending between at least two of said contacts, said housing shield overlying at least a portion of said contact shield extension, said contact shield being electrically commoned with said housing shield.

12. A data connector of claim 11, wherein said contact shields includes additional shield extensions, one additional shield extension bounding each side of said row of contacts.

13. A data connector of claim 11, wherein said electrical contacts are elongate, each contact being of predetermined length, said contact shield extension having a longitudinal portion spanning the length of said contacts.

14. A data connector comprising:

a housing;

an insulative contact holding member supported by said housing and supporting a row of plural spaced electrical contacts thereon;

said contacts being elongate and including a termination end, an interconnection end and a central portion therebetween; and a contact shield supported by said contact holding member, said contact shield having a shield extension extending between at least two of said contacts, said contact shield extension having a longitudinal portion spanning the length of said at least two contacts from their termination ends to their interconnection ends.

15. A data connector of claim 14, wherein said termination end of each said contact includes an insulation displacement contact portion for terminating a conductor of a multiconductor cable.

16. A data connector of claim 15, wherein said interconnection end includes a cantilevered portion for interconnection with a mating contact having a complementary cantilevered portion.

17. A data connector of claim 14, wherein said housing is insulative and supports a conductive housing shield having an extent at partially overlying said contact shield extension.

* * * * *